US005551808A

United States Patent [19]

Sandanasamy et al.

[11] Patent Number: 5,551,808

[45] Date of Patent: Sep. 3, 1996

[54] INTERLOCKING JOINT

[75] Inventors: Richard D. Sandanasamy; Joaquim P. Siu, both of Singapore, Singapore

[73] Assignee: RasWILL Representative Pte. Ltd., Singapore, Singapore

[21] Appl. No.: 252,230

[22] Filed: Jun. 1, 1994

[30] Foreign Application Priority Data

Jun. 2, 1993 [GB] United Kingdom ..... 9311320

[51] Int. Cl.[6] ..... E02D 5/14

[52] U.S. Cl. ..... 405/279; 405/274

[58] Field of Search ..... 405/274–281, 405/267

[56] References Cited

U.S. PATENT DOCUMENTS

| | | | |
|---|---|---|---|
| 2,020,315 | 11/1935 | Hughes | 405/278 |
| 3,302,412 | 2/1967 | Hunsucker | 405/278 |
| 4,808,039 | 2/1989 | Fischer | 405/274 X |
| 4,863,315 | 9/1989 | Wickberg | 405/278 |
| 5,163,785 | 11/1992 | Zanelli et al. | 405/279 X |
| 5,360,293 | 11/1994 | Brfaux et al. | 405/274 X |

FOREIGN PATENT DOCUMENTS

| | | | |
|---|---|---|---|
| 0129275 | 9/1987 | European Pat. Off. . | |
| 0283770 | 9/1988 | European Pat. Off. . | |
| 0286068 | 10/1988 | European Pat. Off. | 405/279 |
| 1-280122 | 11/1989 | Japan | 405/274 |
| 1145325 | 3/1969 | United Kingdom | A44B 19/14 |

*Primary Examiner*—Michael Powell Buiz
*Assistant Examiner*—Frederick Lagman
*Attorney, Agent, or Firm*—Stoel Rives LLP

[57] ABSTRACT

An interlocking joint for linking sheets attached to or incorporating the joint together in a sealed manner to form a screen, the joint comprising a hook portion extending substantially along the length of a free edge of the joint, a rib portion extending substantially along the length of the joint adjacent the hooked portion and a hook receiving portion, the hooked portion and the ribbed portion defining a first space therebetween and the hook receiving portion and the rib portion defining a second space therebetween, wherein the shape of the first space substantially corresponds to the shape of the ribbed portion and the shape of the second space substantially corresponds to the shape of the hooked portion such that the interlocking joint can slidably receive a substantially identical interlocking joint.

19 Claims, 4 Drawing Sheets

INTERLOCKING JOINT

FIELD OF THE INVENTION

The present invention relates to an interlocking sealing joint and more particularly to an interlocking joint for joining sheets together to form a screen for use in sealing an area of underground soil from ground water or contaminated soil and/or water.

BACKGROUND OF THE INVENTION

European Patent document EP-A-0 129 275 discloses a series of thin walled sheets which are joined together by locks which are formed with thick walls along the vertical free edges of the sheets. Each lock consists of a male end adapted to be fixed to a sheet and a female end adapted to be fixed to an adjacent sheet. The male and female ends interlock the sheets to create a watertight screen. The female end is provided with a longitudinally extending slot which extends along the length of its thick wall. Free edges of the slot are turned in toward one another such that the slot can receive a head portion of the male end of the lock. The head portion is retained in the slot by the free edges of the slot.

Accordingly, when connecting two adjacent sheets together it is necessary to provide a first sheet with a male locking portion and a second sheet with a female locking portion to enable the respective lock components to interlock. Thus, the sheets provided with the lock components must be oriented in the correct direction to ensure that male and female lock components are adjacent one another to enable the lock components to interlock to form the screen. Additionally, the production of a lock having a male and a female portion requires the use of two moulds to produce matched pairs of lock components. Further, when a supplier provides an end user with the matched pairs of lock components, equal quantities of both male and female lock components must be supplied. Consequently, two extruders are required to operate simultaneously if the producer wishes to avoid downtime caused by changing moulds on a single extruder.

An expansion seal is located in the slot of the female end to improve the sealing quality of the lock thereby providing a watertight joint. Usually, upon contact with moisture, an expansion seal will swell to a larger size to seal small gaps. However, it is normal practice for the expansion seal to be manually inserted into the slot on site. The situation may arise where a construction worker either neglects or purposely omits inserting the seal thereby reducing the integrity of the watertight seal between the locks. Moreover, a broken seal or two seals can sometimes be inserted in the slot such that the seal is not continuous along the length of the slot. This may also serve to reduce the quality of the seal.

Further, expansion seals include hydrophilling agents which are mixed with a formulation, the major constituent of which nitryl rubber. As the seal comes into contact with water and the seal expands, some of the hyrophilling agent is released into the water or liquid surrounding the seal. When the seal begins to dry, the seal shrinks and, because some of the hydrophilling agent has been lost to the water surrounding the seal, the next time the seal becomes wet, the seal is unable to expand to its originally expanded state. Thus, over time, the integrity of the seal in the interlocking joint is reduced thereby making the seal less effective.

BRIEF DESCRIPTION OF THE INVENTION

It is an object of the present invention to provide a locking joint which alleviates or removes the problems associated with the conventional locking joint.

Accordingly, one aspect of the present invention provides an interlocking joint for linking sheets attached to or incorporating the joint together in a sealed manner to form a screen, the joint comprising a hook portion extending substantially along the length of a free edge of the joint, a rib portion extending substantially along the length of the joint adjacent the hooked portion and a hook receiving portion, the hooked portion and the ribbed portion defining a first space therebetween and the hook receiving portion and the rib portion defining a second space therebetween, wherein the shape of the first space substantially corresponds to the shape of the ribbed portion and the shape of the second space substantially corresponds to the shape of the hooked portion such that the interlocking joint can slidably receive another interlocking joint.

DESCRIPTION OF THE DRAWINGS

In order that the present invention may be more readily understood, embodiments thereof will now be described, by way of example, with reference to the accompanying drawings, in which.

DETAILED DESCRIPTION OF PREFERRED EMBODIMENTS OF THE INVENTION

Figure 1:
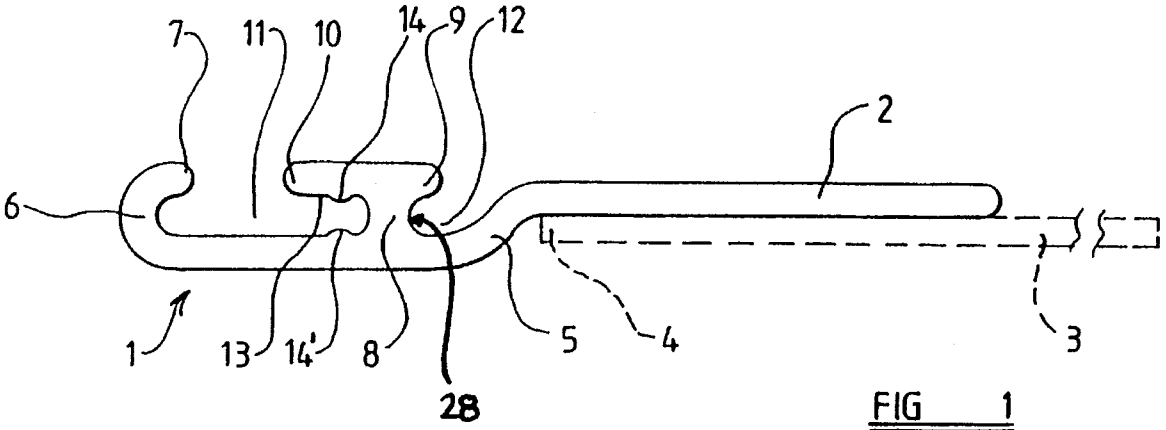
FIG. 1 is a cross section through an interlocking joint embodying the present invention attached to a screen sheet which is shown in phantom.

FIG. 1 illustrates an interlocking joint embodying the present invention. The joint 1 is preferably constructed from a high density polyethylene or from any other material which exhibits a high chemical resistance or inertness to contaminants or chemicals present in ground water or contaminated underground sites. The joint 1 is attached to the vertical free edge of a sheet which can be located in the ground to prevent movement of ground water or contaminants in soil. A number of such sheets provided with joints 1 can be joined together to form an impermeable screen.

Each joint 1 consists of a longitudinal strip having an attachment plate 2 which is to be attached in a sealed manner to a screen sheet 3 at the vertical free edge 4 of the screen sheet 3. The attachment plate 2 is moulded to form a kinked portion 5 at a position adjacent a free edge 4 of the screen sheet 3 such that the free edge 4 of the screen sheet 3 abuts the kinked portion 5 of the attachment plate 2. The kinked portion 5 extends substantially parallel away from the attachment plate 2 and terminates in a hook portion 6, a lip 7 of the hook portion 6 comprises the other free edge of the joint opposite the free edge 4.

A longitudinally extending rib 28 is provided between the hook portion 6 and the kinked portion 5 and comprises a T-shaped flange 8 having a base and two opposite outwardly facing free edges 9, 10. The two free edges 9,10 of the T-shaped flange 8 extend away from one another and parallel with the attachment plate 2. The free edge 10 which is opposite the lip 7 of the hook portion 6 protrudes slightly further from the base of the T-shaped flange 8 than the other free edge 9 of the T-shaped flange 8. The T-shaped flange 8 divides the space between the hook portion 6 and the kinked portion 5 into two longitudinally extending spaces 11,12.

The first space 11 between the hook portion 6 and the T-shaped flange 8 consists of a longitudinally extending slot having two inwardly facing opposed lips, the first lip being formed by the lip 7 of the hook portion 6 and the second opposed lip being formed by one of the longitudinally extending free edges 10 of the T-shaped flange 8.

The second space 12 consists of a slot located between the T-shaped flange 8 and the kinked portion 5, the slot having an in-turned lip which consists of the other free edge 9 of the T-shaped flange 8.

Figure 2:
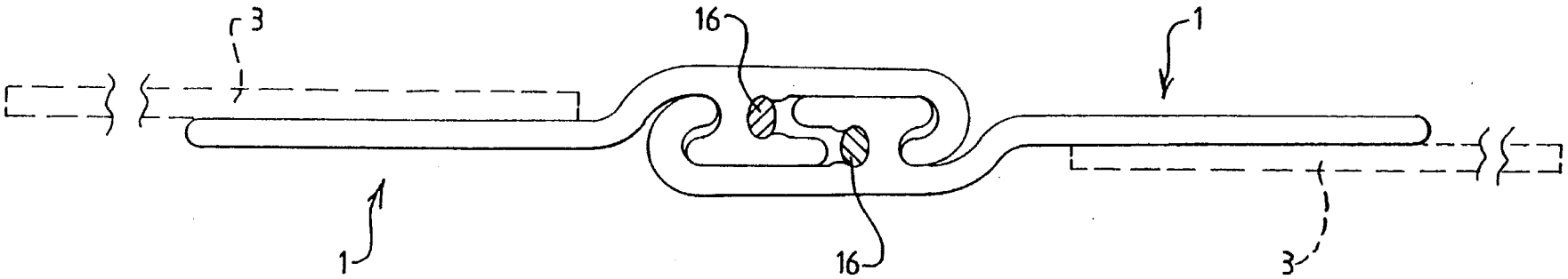
FIG. 2 is a cross section through two locking joints embodying the present invention shown in an assembled condition.
Figure 3:
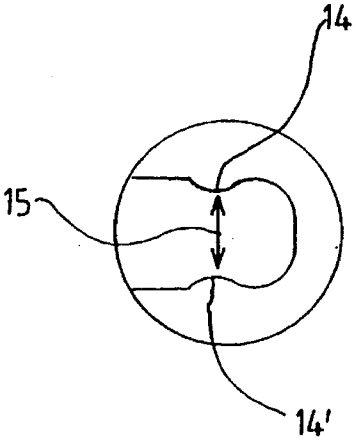
FIG. 3 is an enlarged detailed cross section of an expansion seal receiving portion of the joint of FIG. 1.

When viewed in cross section as shown in FIGS. 1 and 2, the second space 12 defined between the T-shaped flange 8 and the kinked portion 5 has a profile which corresponds to the profile of the hooked portion 6. Similarly, the first space 11 located between the hooked portion 6 and the T-shaped flange 8 has a profile which substantially corresponds to the profile of the T-shaped flange 8 when viewed in cross section. However, the first space 11 is somewhat larger than the size of the T-shaped flange 8 such that an eave 13 is formed underneath the free edge 10 protruding from the T-shaped flange 8 opposite the hook portion 6. The surface of the joint 1 at the eave 13 is formed with a longitudinally extending raised portion 14 and a similar raised portion 14' is formed on the surface of the joint 1 opposite the eave 13. The two raised portions 14, 14' define a neck 15 which can be seen more clearly in FIG. 3.

Since the second space 12 can accommodate a hooked portion 6 and the first space 11 can accommodate a T-shaped flange portion 8, two identical interlocking joints 1 may be placed inverted and adjacent one another such that the hooked portions 6 of each identical joint 1 can be received in the second spaces 12 of the respective other identical joint 1 and the T-shaped flange portions 8 of each identical joint 1 can be received in the first spaces 11 of the respective other identical joint 1. The joints 1 are slidably received within one another to result in an interlocking joint such as the one shown in FIG. 2.

FIG. 2 also shows the interlocking joints 1 fitted with expansion seals 16 which run the length of the joint 1. The expansion seals 16 include a hydrophilling agent such that when the expansion seals 16 become wet, their volume expands. Preferably, rather than having the hydrophilling agent mixed with a formulation whose main constituent is nitryl rubber, the hydrophilling agent is trapped within a polymer such that when the expansion seals 16 comes into contact with water, the expansion seal 16 still expands but no hydrophilling agent is lost to the water with which the seal 16 is in contact. Preferably, when the seal 16 comes in contact with water, the volume of the seal is doubled.

The expansion seals 16 are held in place under the eaves 13 of the T-shaped flanges 8 by the narrow neck 15. The diameter of the unexpanded expansion seal 16 is greater than the dimension of the neck 15 so the expansion seal 16 is firmly held under the eave 13.

Figure 4:
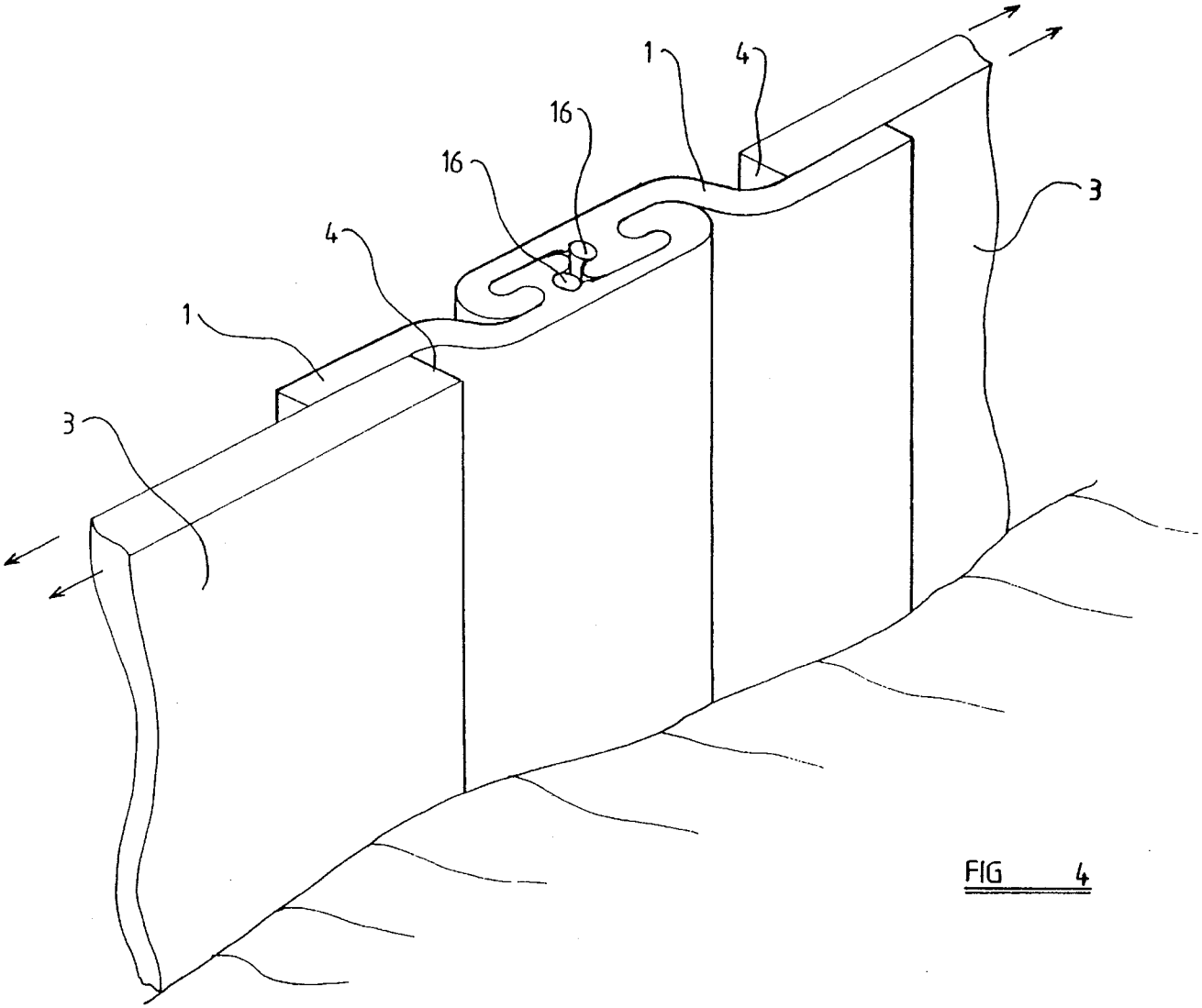
FIG. 4 is a perspective view of the two joints shown in FIG. 2 attached to screen sheets and partially inserted in the ground.

The interlocking joint 1 may be provided in the form of coils or in specified lengths. A joint 1 of corresponding length to the screen sheet 3 is attached to the two vertical free edges 4 of the screen sheet 3 by the attachment plate 2 of each joint 1 as shown in FIG. 4. An expansion seal 16 is provided under the eave 13 formed in the T-shaped flange 8 after the joint 1 has been welded to the sheet 3, or alternatively, before the joint 1 has been welded to the screen sheet 3. The expansion seal 16 is continuous and of substantially the same length as the joint 1 welded to the screen sheet 3. Accordingly, when the screen sheet 3 and joints 1 are placed in the ground to prevent ground water movement, the expansion seals 16 (one located in each joint 1) will come in contact with ground water or the like and the expansion seal 16 will expand within the first space 11 of each of the two joints 1 between the two T-shaped flanges 8 thus sealing the interlocking joints 1. By providing an expansion seal 16 in each of the joints 1, a double seal results. Additionally, due to the location of the expansion seals 16, as the expansion seals 16 expand, the respective joints 1 are prevented from moving substantially with respect to another thus improving the overall integrity of the seal.

FIG. 4 shows two screens 3 joined by two sealing joints 1 in the ground. The screen sheet 3 is sunk into the ground up to a depth at which the screen sheet 3 reaches an impermeable layer of, for example, clay. The ground water in the soil on one side of the screen sheet 3 cannot leak or pass through the screen sheet 3 joined by the sealing joint 1 thereby protecting the soil or structure on the other side of the screen sheet 3.

In a second embodiment of the present invention there is provided a joint 1 which is extruded in a form which is already provided with an expansion seal 16. The expansion seal 16 is co-extruded with the joint 1 in the production process and embedded in the joint 1 at substantially the same position shown in FIG. 2. This eliminates the need for expansion seals 16 to be inserted by construction workers thus eliminating any risks associated with the fitting of expansion seals 16 on site. If, for example, the expansion seal 16 is not included in the joint 1 by either human error or as an attempt to save costs, a lower quality seal will result. By co-extruding the expansion seal 16 in situ with the joint 1, these problems can be avoided.

Conveniently, the expansion seal 16 is formed from a thermoplastic material such as thermoplastic rubber and is co-extruded as a bead to form an integral part of the joint 1 which is formed from high density polyethylene. Materials other than high density polyethylene can be co-extruded with the expansion seal 16.

Figure 7:
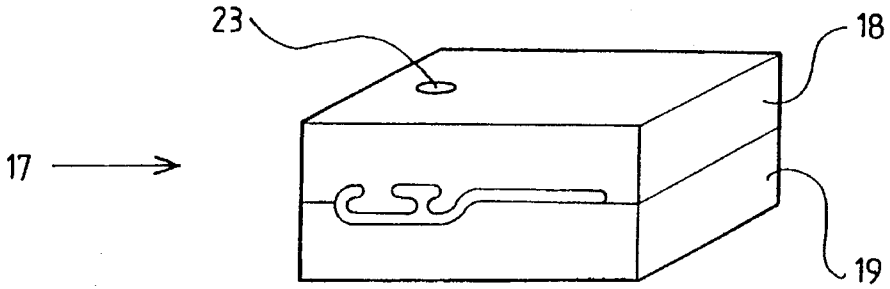
FIG. 7 is an isometric view of a cross-head jig used to co-extrude a seal in an interlocking joint embodying the invention.
Figure 8:
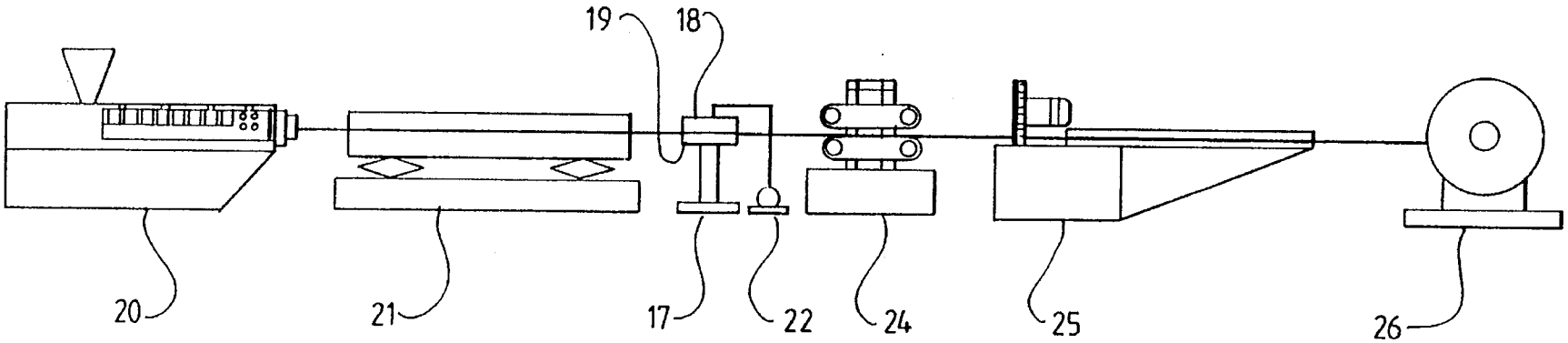
FIG. 8 is a diagrammatic representation of a line assembly for the co-extrusion of an interlocking joint embodying the present invention with a seal.

FIG. 7 shows a cross-head jig 17 comprising two halves 18, 19 which, when registered together define the shape of the joint 1. As seen from FIG. 8, the joint 1 has already been extruded in a profile extruder 20 and cooled in a vacuum cooling tank 21 before being fed into the cross-head jig 17. The cooled extrusion of the joint 1 is fed into the cross-head jig 17 and a volumetric pump 22 pumps a polymer paste containing a hydrophilling agent into the cross-head jig 17 through a bore 23 such that the paste fills the neck 15 of the joint 1 to define an expansion seal 16. The expansion seal paste is of toothpaste consistency and the flow of paste into the cross-head jig 17 is controlled at a constant flow rate by the volumetric pump so that the size of the bead of expansion seal 16 laid in the joint 1 remains constant. The expansion seal paste fills the neck area 15 as shown in FIG. 2.

The expansion seal paste cools as it leaves the cross-head jig 17 and the joint 1 formed with the co-extruded seal 16 is passed through a take-off machine 24 and then to a cutting machine 25 and a coiling machine 26.

By providing a joint 1 which can simply be inverted and interlocked with a corresponding joint 1, it is possible to produce interlocking joints 1 with only one mould. This eliminates the requirement to provide two moulds for respective male and female joints. Additionally, it is not necessary to produce or stock equal quantities of male and female joints as an end user may simply be supplied with a quantity of a single joint 1 which can be interlocked with a corresponding identical joint. The interlocked joints 1 shown in FIG. 2 provide a high quality watertight seal as a result of the joint being provided with a double seal. Seal integrity can be achieved with only a single expansion seal located in one of the two interlocked joints 1.

The screen sheet 3 is attached to the joint 1 by means of welding. In particular, a longitudinally extending double weld is provided on the attachment plate 2 thereby forming an air channel between the attachment plate 2 and the screen sheet 3. The air channel may be pressure tested to verify the integrity of the welds. In general, the welds occupy 30 to 50 mm of the width of the attachment plate 2.

The expansion seals are expensive items and tend to be supplied in reels of standard length, usually 20 m. Overlapping end portions of expansion seals may be joined together thus creating a potential weak spot which could result in a leak. However, in the embodiment of the invention in which the interlocking joint is provided with a double seal, groundwater managing to leak through a weak point in the joined seal will still be prevented from penetrating the double seal by the second seal. The two seals are normally positioned in the interlocking points such that the possible leak points in each joint are not adjacent one another.

Figure 5:
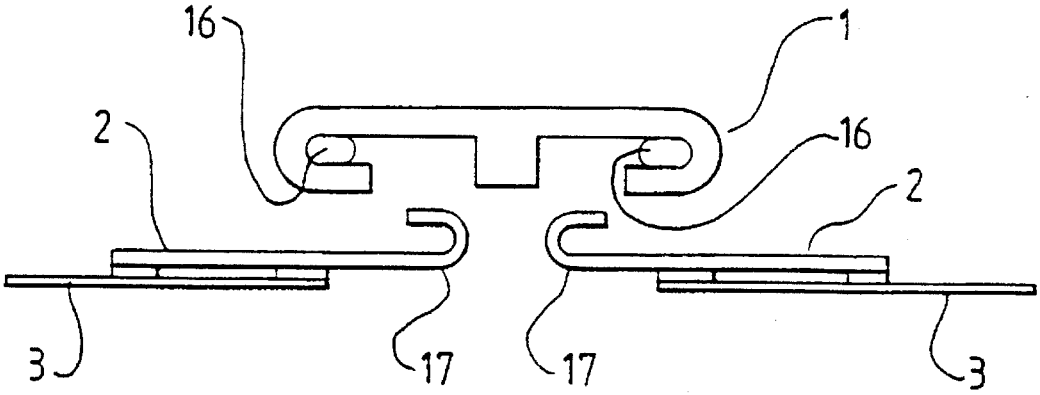
FIG. 5 is a cross section through a co-extruded joint and seal according to a further embodiment of the present invention for interconnecting with two further joints which are shown attached to respective screen sheets.
Figure 6:
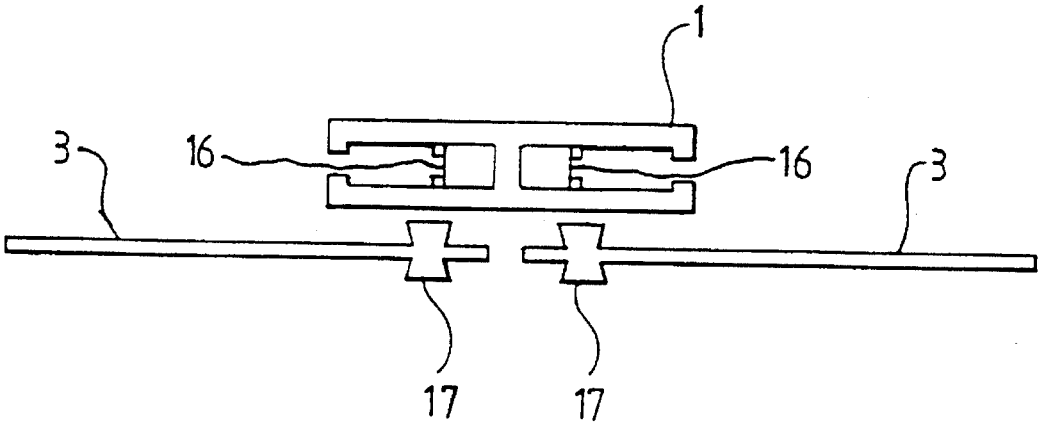
FIG. 6 is a cross section through a co-extruded joint and seal according to another embodiment of the present invention for interconnecting screen sheets integrally formed with end portions to co-operate with the co-extruded joint and seal.

A further embodiment of the invention is envisaged in which a co-extruded joint 1 and seal 16 are provided, two further joints 17 being provided on each screen sheet 3 to be interconnected and the co-extruded joint 1 and seal 16 interconnecting the respective further joints 17 attached to the screen sheets 3. Two examples of this embodiment are shown in FIGS. 5 and 6.

What is claimed is:

1. An interlocking joint for linking sheets together in a sealed manner to form a screen, the joint comprising:

a hook portion extending substantially along the length of a free edge of the joint;

a rib portion extending substantially along the length of the joint adjacent the hook portion, the rib portion having a free rib edge that cooperates with the hook portion to define a rib receiving portion;

a hook receiving portion;

a first space defined between the hook portion and the rib portion, the first space having physical means, discrete from the rib receiving portion, for retaining an expansion seal; and a second space defined between the hook receiving portion and the rib portion, wherein the shape of the first space substantially corresponds to the shape of the rib portion and the shape of the second space substantially corresponds to the shape of the hook portion such that the interlocking joint is adapted to slidably receive another interlocking joint.

2. An interlocking joint according to claim 1, wherein the means for retaining the expansion seal comprises a neck portion formed in the rib portion which is dimensioned to retain an expansion seal when the expansion seal is in an unexpanded state.

3. An interlocking joint according to claim 2, wherein the expansion seal, in an expanded state, contacts the rib portion of a second interlocking joint slidably received within the interlocking joint thereby further sealing the interlocking joint.

4. An interlocking joint according to claim 1, wherein the interlocking joint is formed by an extrusion process.

5. An interlocking joint according to claim 4, wherein an expansion seal is co-extruded with the interlocking joint to produce an interlocking joint formed with an expansion seal.

6. An interlocking joint according to claim 1, wherein an expansion seal is positioned in the first space after the interlocking joint has been formed.

7. An interlocking joint according to claim 1, in which the joint is attached by an attachment means provided on the joint to a sheet, which sheet is for use in providing a barrier for preventing soil or fluid from passing through the sheet.

8. An interlocking joint according to claim 1, wherein the joint is interlockable with an identical joint.

9. A seal comprising two interlocking joints according to claim 1, in which the two interlocking joints are slidably received by one another.

10. An interlocking joint according to claim 1, wherein the hook and rib portions have different shapes and the first and second spaces have different dimensions.

11. An interlocking joint for linking sheets together in a sealed manner to form a screen, which interlocking joint is formed as a co-extrusion of the joint and an expansion seal, which includes a polymer and a hydrophilling agent trapped in the polymer, such that the joint can interlock and be sealed with another joint.

12. An interlocking joint according to claim 11, wherein the interlocking joint is adapted to interlock with a substantially identical interlocking joint.

13. An interlocking joint according to claim 11, wherein two further joints are provided on a screen sheet and the interlocking joint is interconnectable to the two further joints for linking the screen sheets together.

14. An interlocking joint for linking sheets together in sealed manner to form a screen, the joint comprising:

a hook portion extending substantially along the length of a free edge of the joint;

a rib portion extending substantially along the length of the joint adjacent the hook portion, the hook and rib portions having different shape;

a hook receiving portion;

a first space defined between the hook portion and the rib portion;

a second space defined between the hook receiving portion and the rib portion, the first and second spaces having different dimensions; and an expansion seal located in the first space, which interlocking joint is formed by an extrusion process, the seal being co-extruded with the joint and the shape of the first space substantially corresponding to the shape of the rib portion and the shape of the second space substantially corresponding to the shape of the hook portion such that the interlocking joint can slidably receive another interlocking joint.

15. An interlocking joint according to claim 14, wherein the rib portion comprises a free rib edge that cooperates with the hook portion to define a rib receiving portion and wherein the first space between the hook portion and the rib portion is provided with physical means for retaining an expansion seal, the means for retaining the expansion seal being discrete from the rib receiving portion.

16. An interlocking joint according to claim 14, wherein the seal includes a hydrophilling agent.

17. An interlocking joint according to claim 16, wherein the expansion seal comprises a polymer that traps the hydrophilling agent.

18. An interlocking joint according to claim 14, wherein the interlocking joint is adapted to interlock with a substantially identical interlocking joint.

19. An interlocking joint according to claim 14, wherein two further joints are provided on a screen sheet and the interlocking joint is interconnectable to the two further joints for linking the screen sheets together.

* * * * *